US007814706B2

(12) United States Patent
Gamache

(10) Patent No.: US 7,814,706 B2
(45) Date of Patent: Oct. 19, 2010

(54) DUAL-ACTION BREAKAWAY GATE SAFETY SYSTEM

(75) Inventor: Louis A. Gamache, St. Petersburg, FL (US)

(73) Assignee: State of Florida, Department of Transportation, Tallahassee, FL (US)

( * ) Notice: Subject to any disclaimer, the term of this patent is extended or adjusted under 35 U.S.C. 154(b) by 287 days.

(21) Appl. No.: 11/544,700

(22) Filed: Oct. 6, 2006

(65) Prior Publication Data

US 2008/0085149 A1 Apr. 10, 2008

(51) Int. Cl.
*E01F 13/00* (2006.01)

(52) U.S. Cl. ..... 49/49; 49/9

(58) Field of Classification Search ..... 49/9, 49/49, 34, 141; 404/9, 10
See application file for complete search history.

(56) References Cited

U.S. PATENT DOCUMENTS

| | | | | | |
|---|---|---|---|---|---|
| 1,665,157 | A * | 4/1928 | Dahnke | 49/247 |
| 1,832,232 | A * | 11/1931 | Mimms | 49/93 |
| 1,945,295 | A | 1/1934 | Pranger | |
| 2,874,493 | A | 2/1959 | Mandel | |
| 3,419,798 | A * | 12/1968 | Walton | 324/251 |
| 4,227,344 | A | 10/1980 | Poppke | |
| 4,364,200 | A * | 12/1982 | Cobb | 49/192 |
| 4,531,325 | A | 7/1985 | Phillips | |
| 4,897,960 | A | 2/1990 | Barvinek | |
| 6,179,517 | B1 * | 1/2001 | Nelson | 404/6 |
| 6,212,825 | B1 | 4/2001 | Hopkins | |
| 6,327,818 | B1 | 12/2001 | Pease | |
| 6,370,821 | B1 | 4/2002 | McCord | |
| 6,460,292 | B1 | 10/2002 | Rodriguez | |
| 6,966,146 | B2 | 11/2005 | Pease | |
| 2006/0228177 | A1 * | 10/2006 | Allain et al. | 404/6 |

* cited by examiner

*Primary Examiner*—Gregory J. Strimbu
(74) *Attorney, Agent, or Firm*—J. Wiley Horton

(57) ABSTRACT

A safety system for use with a boom gate. The boom gate includes a boom and a boom operator for moving the boom between a down position and an up position. The safety system also has a boom deflection detector for detecting deflection of the boom, such as deflection caused by collision of the boom with a vehicle. A control system is provided for actuating the boom operator to move the boom to the up position whenever deflection is detected.

10 Claims, 14 Drawing Sheets

DUAL-ACTION BREAKAWAY GATE SAFETY SYSTEM

BACKGROUND OF THE INVENTION

1. Field of the Invention

This invention relates to the field of boom gates, such as the type that are used to control vehicular traffic. More specifically, the present invention comprises a dual-action breakaway gate safety system.

2. Description of the Related Art

Boom gates are common devices used to control vehicular traffic. They are commonly used to regulate vehicular access to parking garages, industrial or commercial areas, and tollways. They are also used to block roadways that cross railroad tracks when trains approach and cross the roadways.

Most boom gates are electronically controlled so that an authorized vehicle is permitted to pass through the gate when the authorized vehicle approaches the gate. Various mechanisms are used to regulate the opening of the boom gate. Bar code scanners, card readers, infrared motion detectors, and currency counters are all commonly used to send a "raise boom" command to a controller. The controller actuates a motor in the gate housing to raise the boom gate when this signal is received. Motion sensors or sensors embedded in the roadway are often used to provide an "all clear" signal to the controller when the vehicle is clear of the boom gate. The controller actuates the motor to lower the boom gate when the "all clear" signal is received.

Vehicles approaching a boom gate often slow without coming to a complete stop. In some instances a boom gate fails to open when an authorized vehicle approaches the gate and the vehicle strikes the boom gate. Also, sometimes a boom gate lowers before a vehicle has completely passed through the gate. In either case, damage may be caused to the gate, the vehicle, and/or persons riding in the vehicle. Various safety systems have been proposed to limit damage caused by the collision of vehicles with boom gates. These systems have various shortcomings which have prevented their widespread acceptance. Accordingly, it would be desirable to have a safety system for boom gates which addresses the shortcomings of prior art boom gate safety systems and limits the damage caused by the collision of vehicles with a boom gate.

BRIEF SUMMARY OF THE INVENTION

The present invention comprises a safety system for use with a boom gate. The boom gate includes a boom and a boom moving means for moving the boom between a down position and an up position. The safety system also has a boom deflection detector for detecting deflection of the boom, such as deflection caused by collision of the boom with a vehicle. A control system is provided for actuating the boom moving means to move the boom to the up position whenever deflection is detected.

In the preferred embodiment a combination hinge is used to permit the boom to deflect in both a horizontal and vertical direction. The combination hinge includes a horizontal pivot joint and a vertical pivot joint. The horizontal pivot joint permits the boom to deflect in an upward direction when the boom collides with an object such as a vehicle. The vertical pivot joint permits the boom to deflect in a horizontal direction upon collision. The combination hinge joint is spring biased to retain the boom in a normal, undeflected position. The spring also acts to return the boom to the normal, undeflected position after the boom has been deflected. In the preferred embodiment the means for detecting deflection of the boom is configured to detect both horizontal deflection and vertical deflection of the boom.

The boom deflection detector may include a magnet attached to an outside pivot plate and a sensor configured to sense the magnet attached to the control arm at a fixed location. Deflection of the boom causes the magnet to move away from the sensor. In the preferred embodiment, the control system is configured to actuate the boom moving means to move the gate to the up position whenever the boom deflection detector detects angular deflection exceeding approximately fifteen degrees or more in either the horizontal or vertical direction.

REFERENCE NUMERALS IN THE DRAWINGS

| | | | |
|---|---|---|---|
| 10 | gate housing | 12 | spring housing |
| 14 | combination hinge | 16 | hinge |
| 18 | boom mount | 20 | hinge |
| 22 | boom | 24 | sensor |
| 26 | magnet | 28 | outside pivot plate |
| 30 | fastener | 32 | vertical pivot joint |
| 34 | pin | 36 | connector |
| 38 | cable | 40 | horizontal pivot joint |
| 42 | pin | 44 | spring |
| 46 | plate | 48 | top block |
| 50 | bottom block | 52 | latch |
| 54 | latch | 56 | boom receiver |
| 58 | inside pivot plate | 60 | control arm |
| 62 | counterweight | 64 | spring tube |

DETAILED DESCRIPTION OF THE INVENTION

Figure 1:
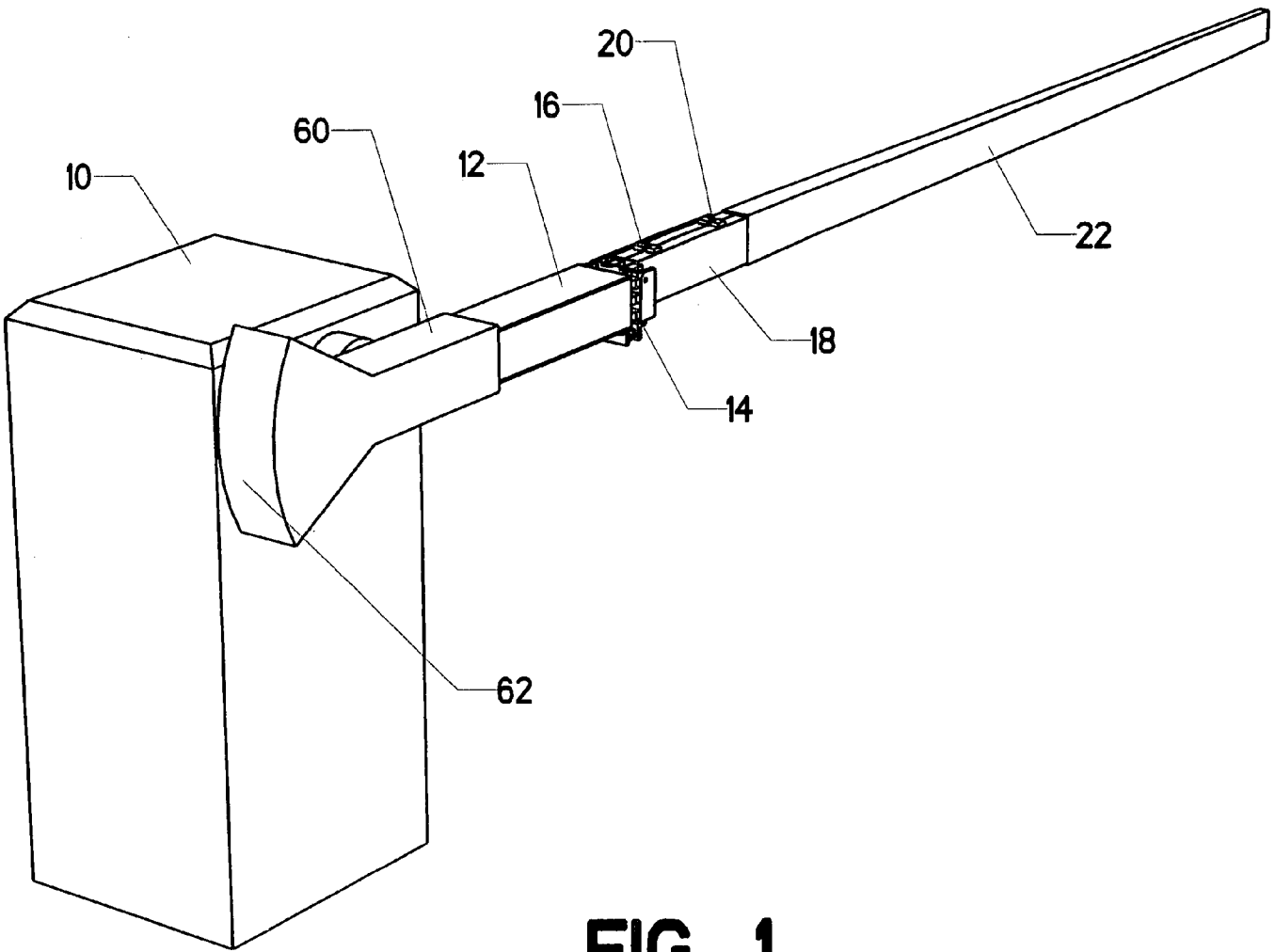
FIG. 1 is a perspective view, showing a boom gate equipped with a gate safety system.

As illustrated in FIG. 1, the present invention comprises a safety system for use with a boom gate. The boom gate includes gate housing 10, which encloses various mechanical and electrical components used to operate the boom gate. For example, gate housing 10 houses a boom moving means for moving boom 22 between a down position (shown in FIG. 1) and an up position (shown in FIG. 2). Various means are known and employed in prior art boom gates for moving boom 22 up and down. Usually an electric motor is used to transmit power to a control arm (spring housing 12) via a gearbox or belts.

A control module is also enclosed in the gate housing. The control module actuates the motor to raise and lower boom 22 in response to an input signal. The input signal may be provided by an infrared motion detector, a card reader, a bar code scanner or other device. The control module of the present invention also includes an "emergency module" which generates a "raise boom" signal whenever an object such as a vehicle collides with the boom gate. This feature will be described in greater detail subsequently.

Figure 2:
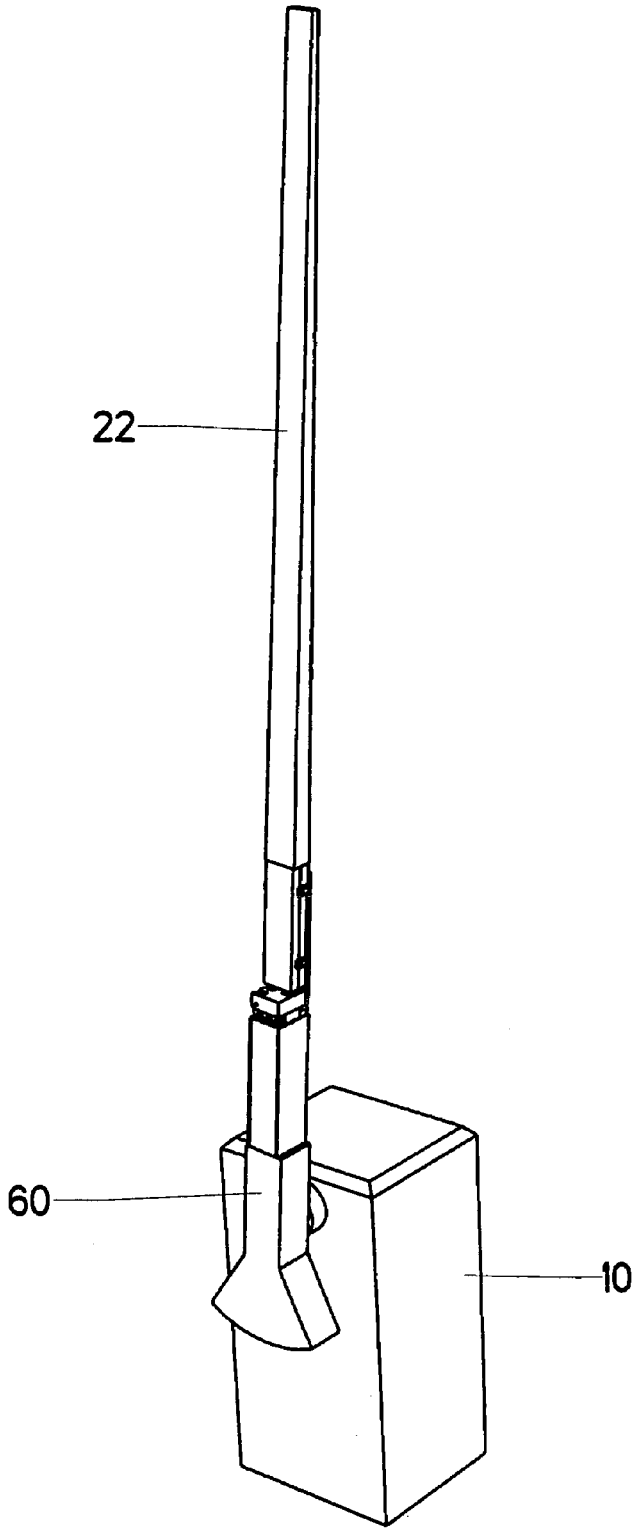
FIG. 2 is a perspective view, showing a boom gate equipped with the gate safety system.

In the preferred embodiment, control arm 60 is operatively connected to a drive shaft which is powered by the electric motor. Spring housing 12 is attached to one end of control arm 60. Counterweight 62 is provided on the other end of control arm 60 to offset the torque created by the weight of the dual action breakaway arm and boom. Control arm 60 is substantially horizontal with the ground when boom 22 is in the down position. Control arm 60 rotates with the drive shaft to a substantially vertical or nearly vertical position when boom 22 is moved to the up position, as shown in FIG. 2. In the preferred embodiment, spring housing 12 has an angular rotation range of 45 degrees to 90 degrees, with a more preferred range of 80 degrees to 90 degrees.

Turning back to FIG. 1, combination hinge 14 is attached between spring housing 12 and boom 22. Boom 22 is attached to combination hinge 14 by boom mount 16. Boom mount 18 includes two mounting blocks which are held together on the top by hinge 16 and hinge 20. Latches are provided on the bottom of boom mount 18. These latches allow boom 22 to be attached to and released from boom mount 18.

Figure 3:
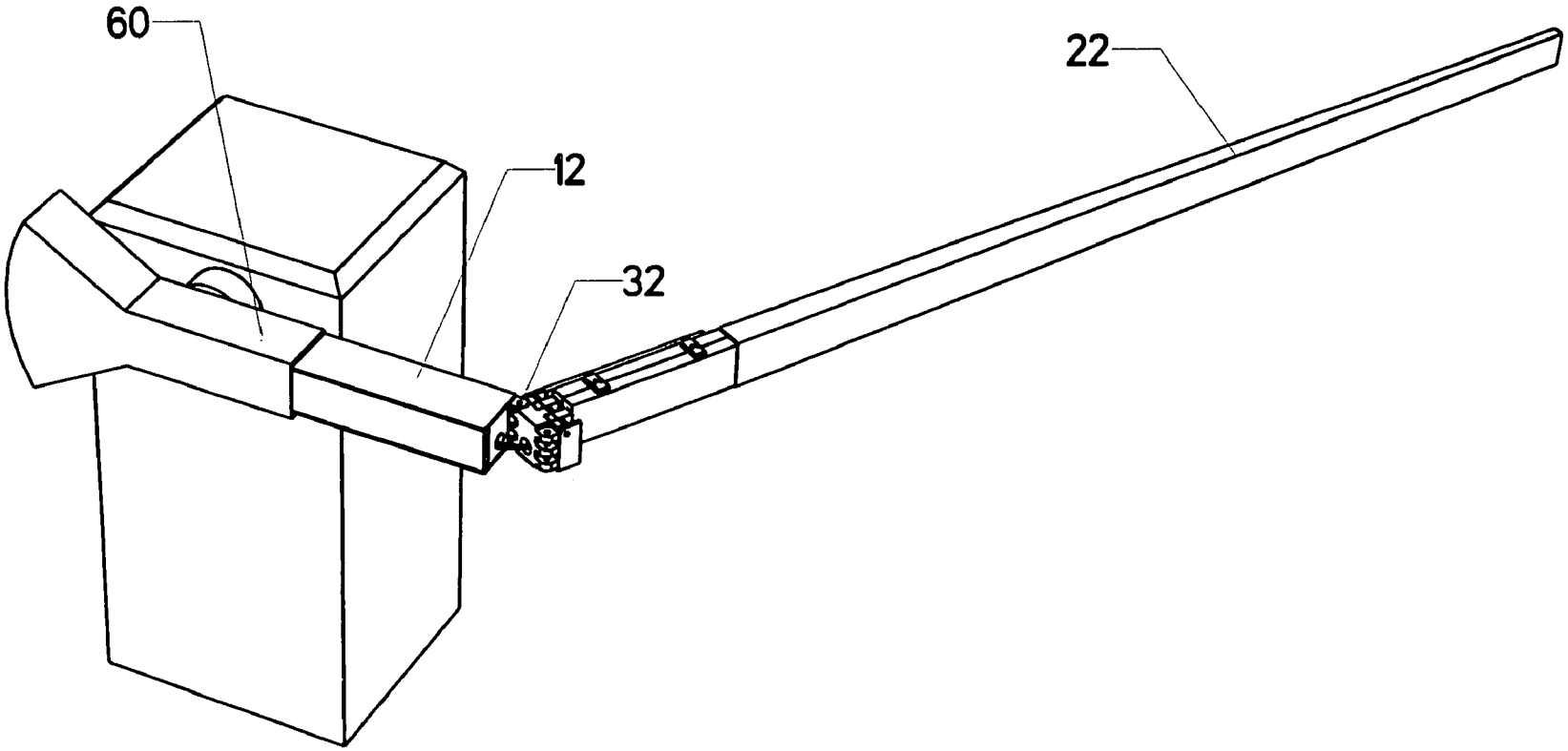
FIG. 3 is a perspective view, showing horizontal deflection of the boom.
Figure 4:
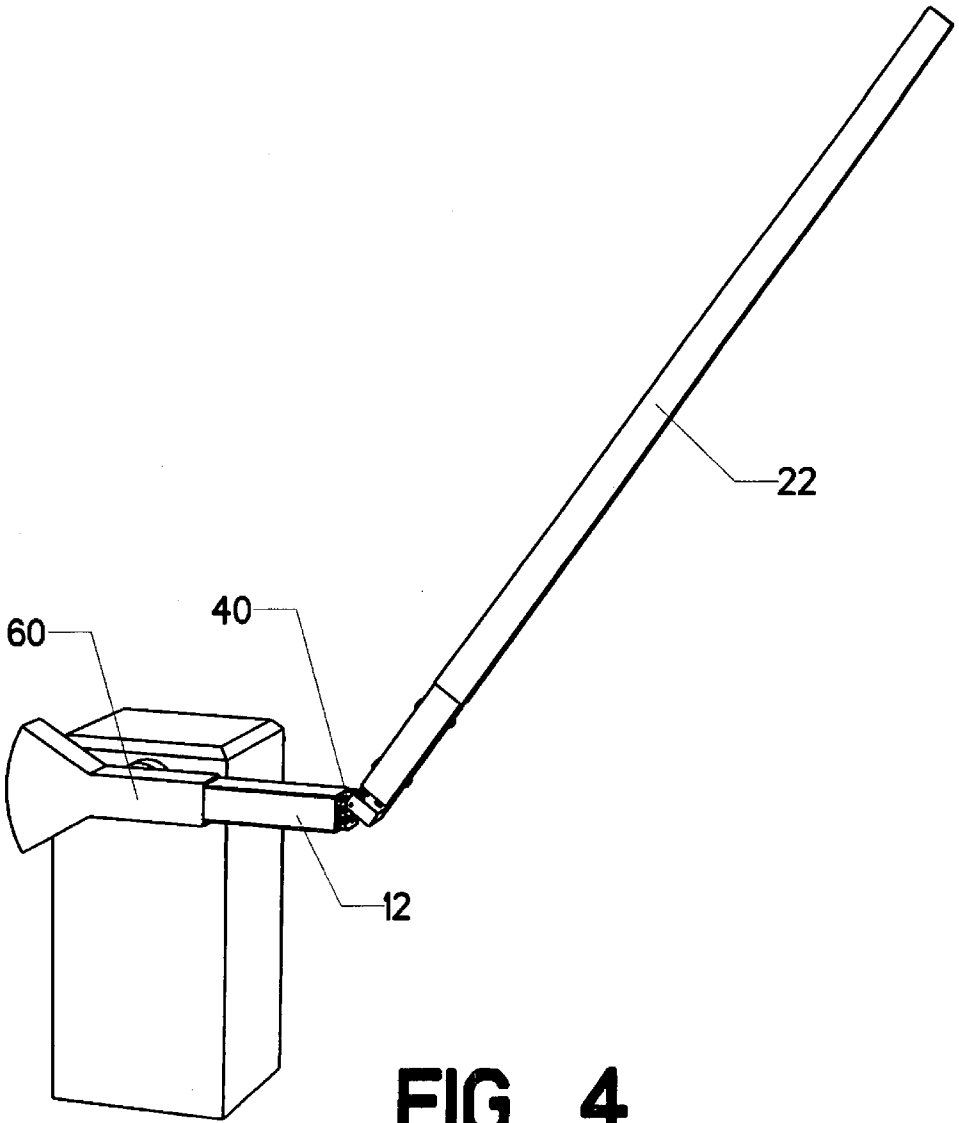
FIG. 4 is a perspective view, showing the vertical deflection of the boom.
Figure 5:
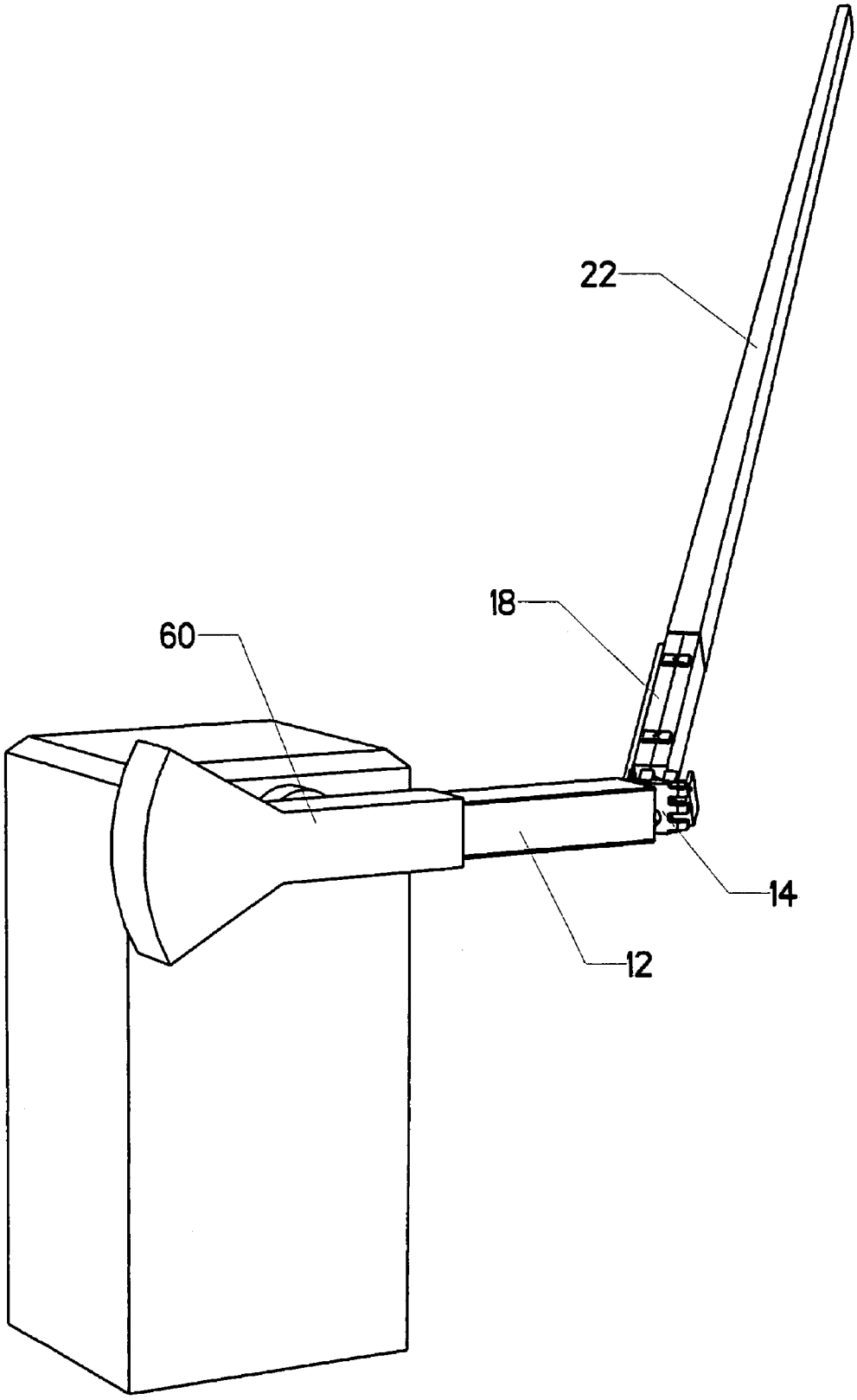
FIG. 5 is a perspective view, showing combined horizontal and vertical deflection of the boom.

Combination hinge 14 permits the boom to deflect in both a horizontal and vertical direction. The combination hinge includes a horizontal pivot joint and a vertical pivot joint. As illustrated in FIG. 3, vertical pivot joint 32 permits boom 22 to deflect in a horizontal direction when the boom collides with an object such as a vehicle. As illustrated in FIG. 4, horizontal pivot joint 40 permits boom 22 to deflect in a vertical direction upon collision. As illustrated in FIG. 5, combination hinge 14 also permits boom 22 to deflect in the horizontal and vertical directions simultaneously.

Figure 6:
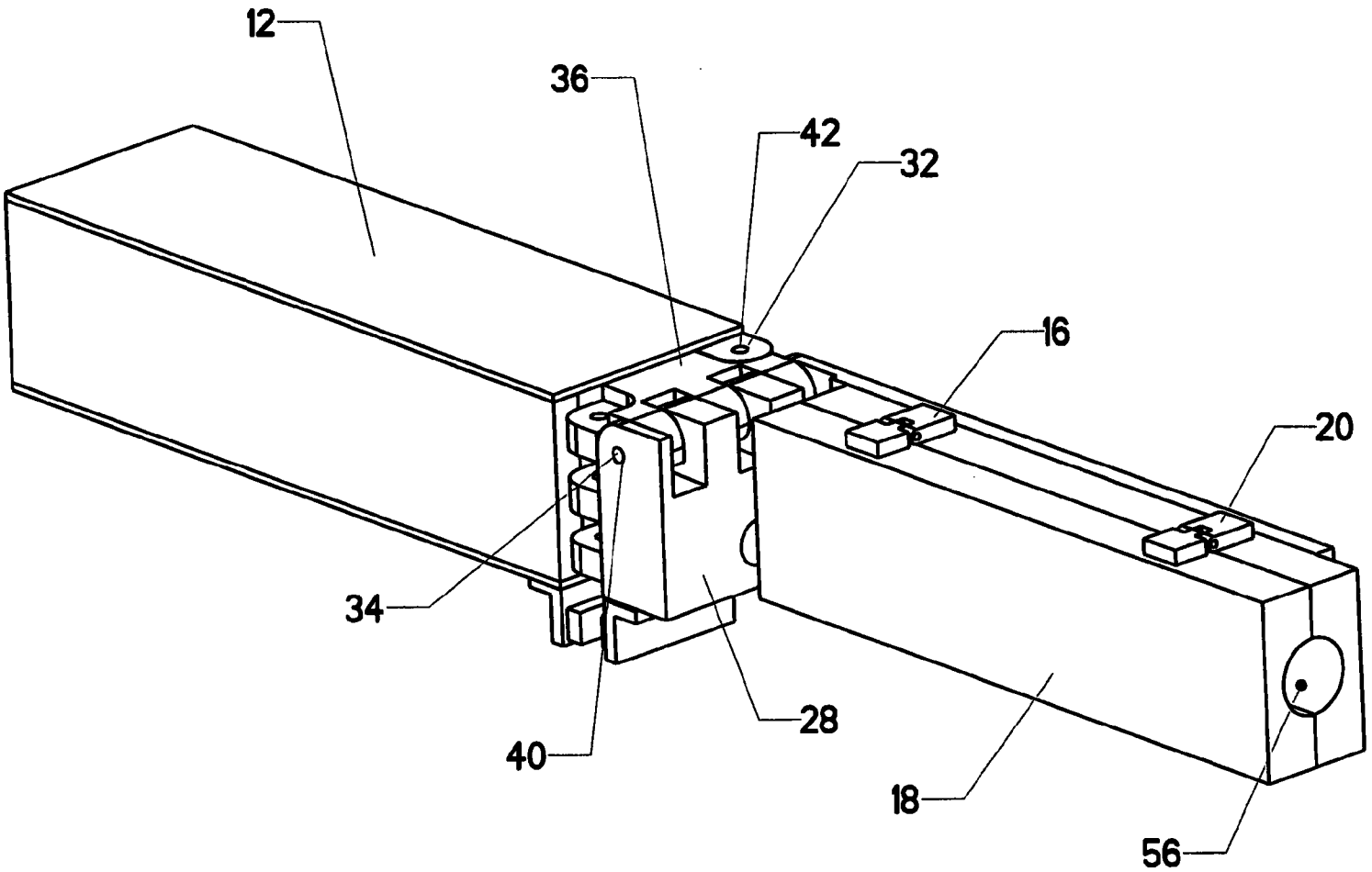
FIG. 6 is a detail view, showing features of the combination hinge.
Figure 7:
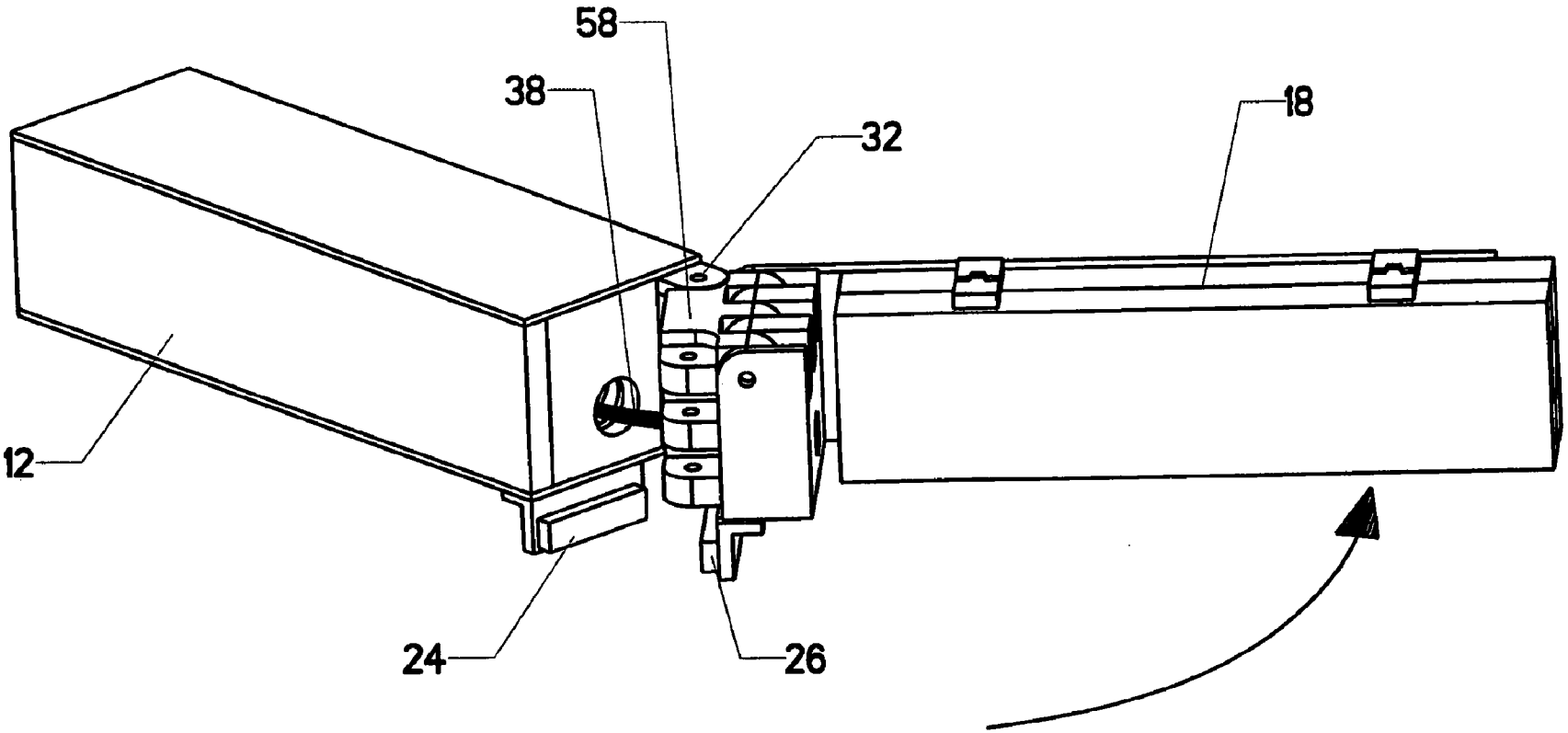
FIG. 7 is a detail view, showing horizontal breakaway of the combination hinge.
Figure 8:
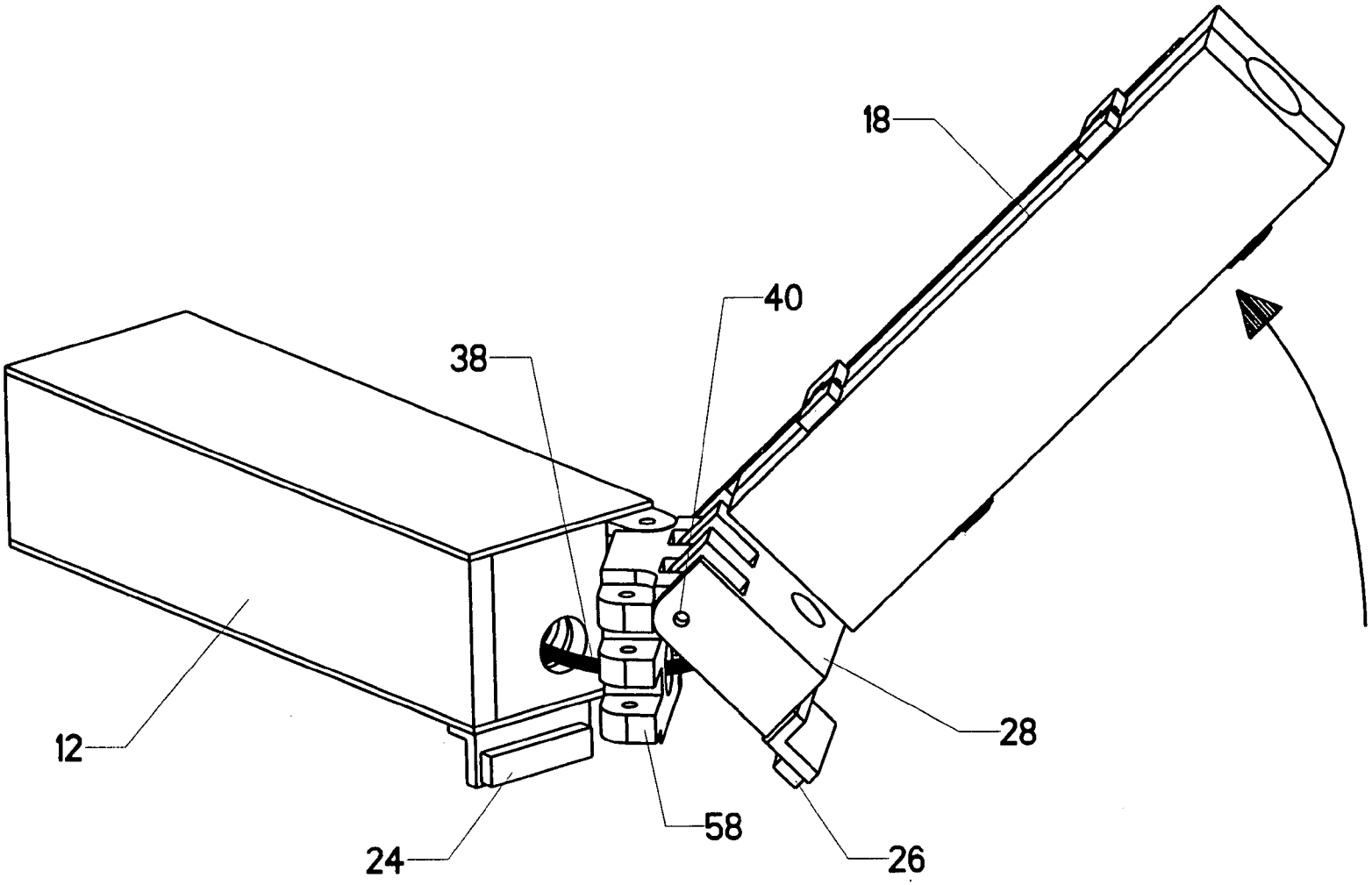
FIG. 8 is a detail view, showing combined horizontal and vertical breakaway of the combination hinge.

A more detailed illustration of the dual action breakaway arm is provided in FIG. 6. The combination hinge is attached to spring housing 12 by vertical pivot joint 32 and pin 42. Vertical pivot joint 32 allows the combination hinge to rotate approximately 90 degrees in the horizontal direction relative to spring housing 12, as illustrated in FIG. 7. Vertical pivot joint 32 attaches inside pivot plate 58 (shown more clearly in FIG. 8) to the end of spring housing 12. Connector 36 is solidly fixed and perpendicularly situated with respect to inside pivot plate 58. Connector 36 and inside pivot plate 58 are actually a single integrated unit. Outside pivot plate 28 is attached to connector 36 by horizontal pivot joint 40 and pin 34. Horizontal pivot joint 40 allows outside pivot plate 28 to rotate approximately 90 degrees in the vertical direction relative to spring housing 12 and connector 36, as illustrated in FIG. 8.

Turning back to FIG. 6, boom receiver 56 is provided in the end of boom mount 18 distal to the combination hinge. Boom receiver 56 is formed by cylindrical cutouts in each of the mount blocks which form boom mount 18. Boom receiver 56 receives a cylindrical shank on the end of the boom, thereby securing the boom to the dual action breakaway arm.

Figure 9:
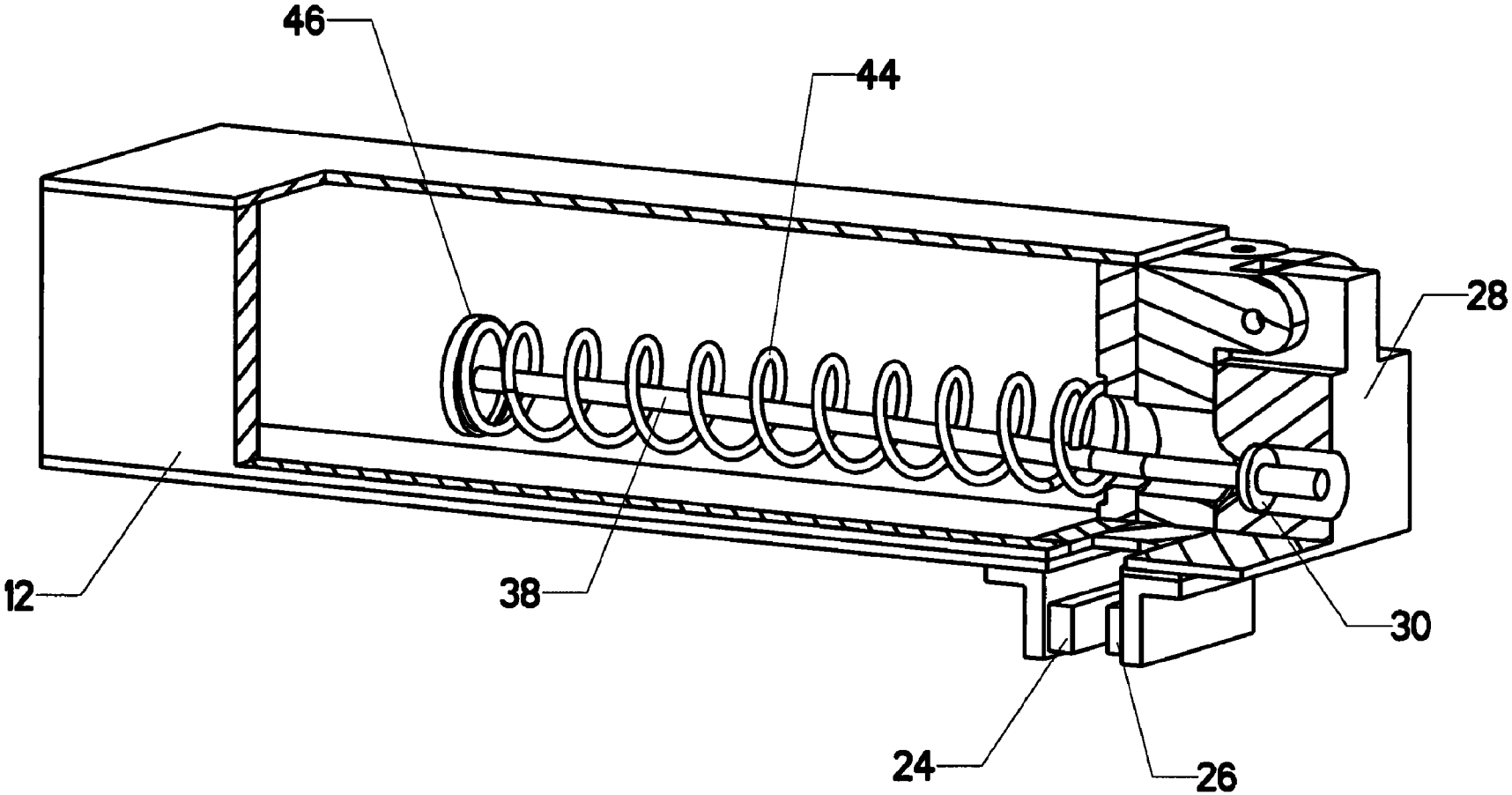
FIG. 9 is a partial section view, showing details of the combination hinge.
Figure 11:
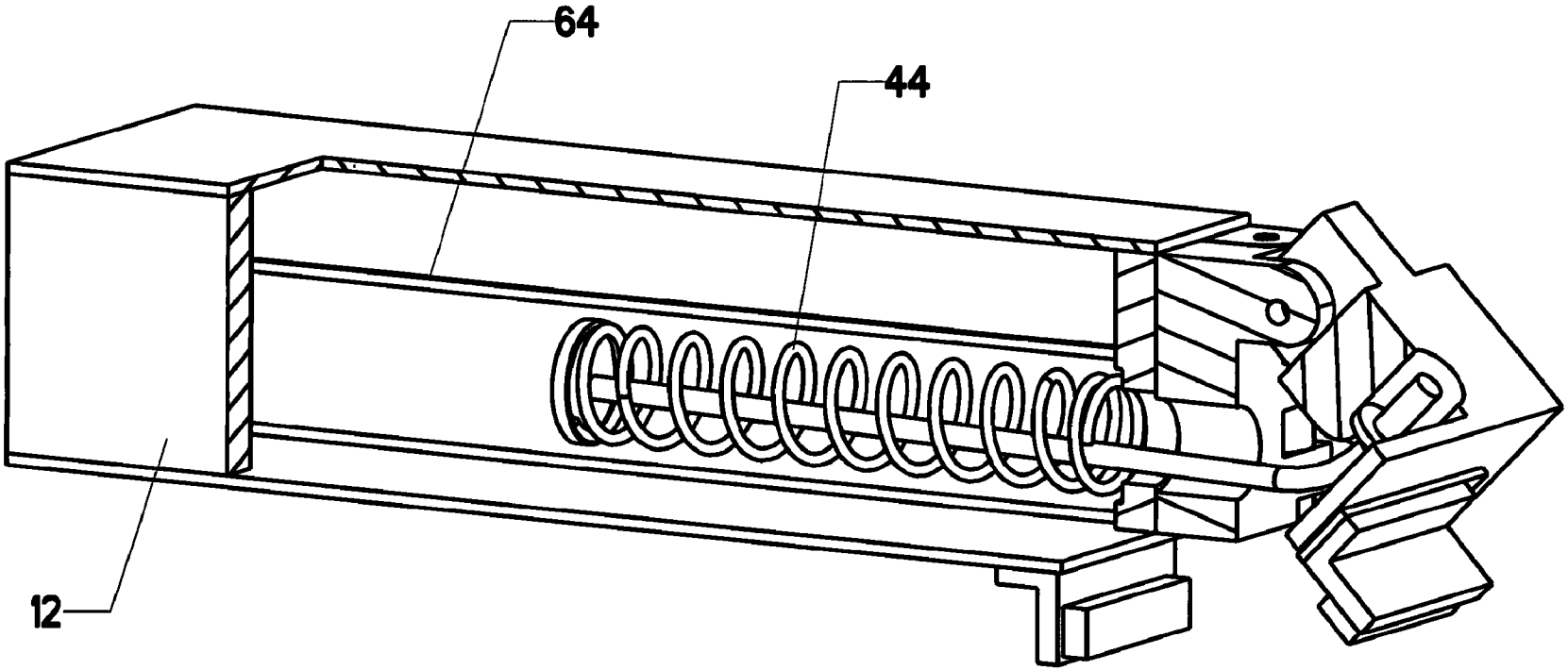
FIG. 11 is a partial section view, showing details of the combination hinge.
Figure 12:
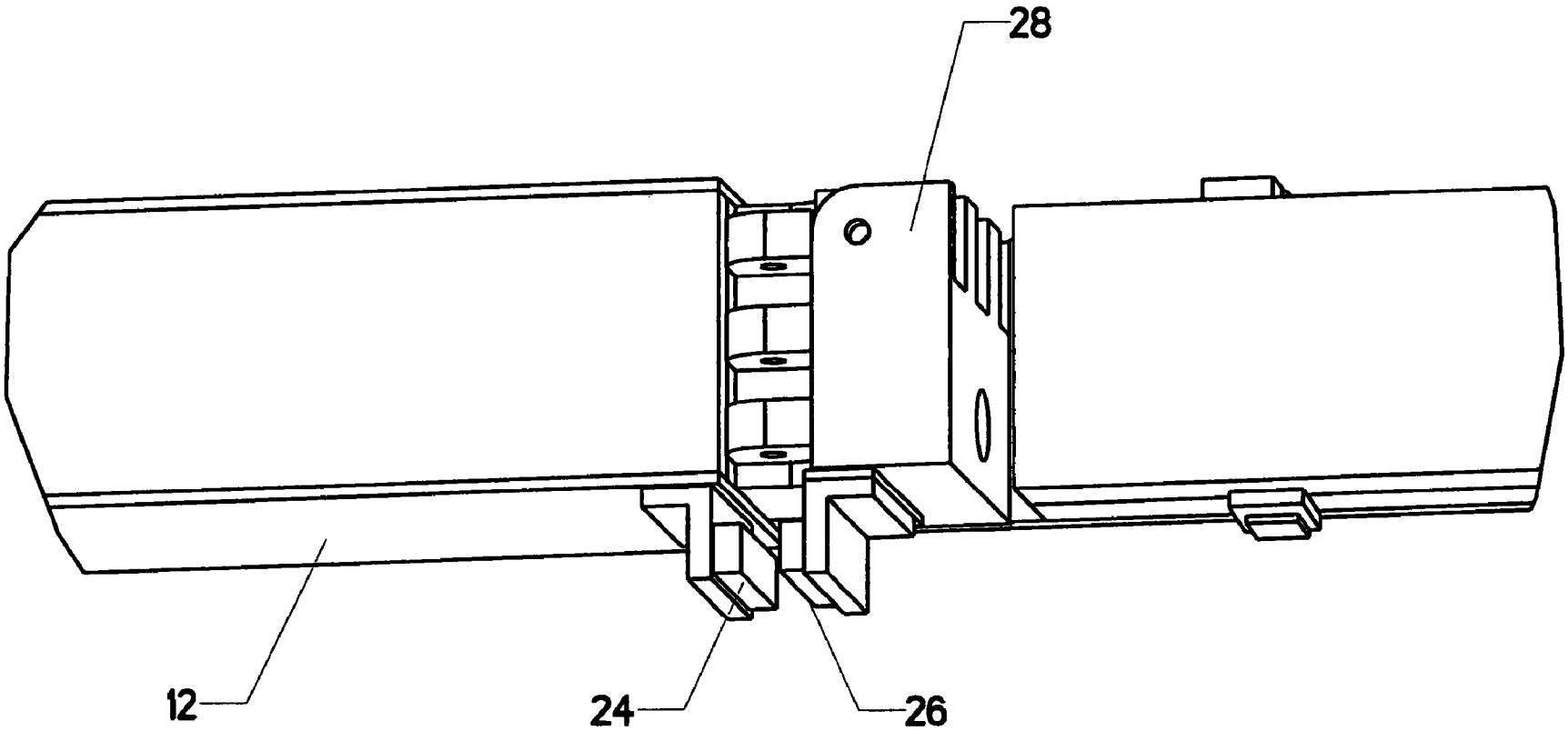
FIG. 12 is a detail view, showing the combination hinge.

As illustrated in FIG. 9, cable 38 attaches to outside pivot plate 28 with fastener 30. Cable 38 passes through a bore in inside pivot plate 58 into spring housing 12. On its end opposite fastener 30, cable 38 has plate 46. Spring 44 is placed between plate 46 and the inside surface of spring housing 12 proximal the combination hinge. Spring 44 is preferably a die spring. The length of cable 38 may be adjusted so that spring 44 maintains tension on cable 38 and keeps the combination hinge in the normal, undeflected position shown in the present illustration. The spring also acts to return the boom to the normal, undeflected position after the boom has been deflected, as will be explained subsequently. As illustrated in FIG. 11, spring 44 is preferably encased in spring tube 64 to reduce the risk of injury when servicing the dual action breakaway arm.

Referring back to FIG. 9, magnet 26 is attached to outside pivot plate 28 so that the two components move together. Sensor 24 is attached to the side, external surface of spring housing 12 near magnet 26. Sensor 24 includes a magnetically-reactive element, such as a magnetic switch. Accordingly, when magnet 26 moves away from sensor 24, sensor 24 reacts to the movement of the magnetic field.

Figure 10:
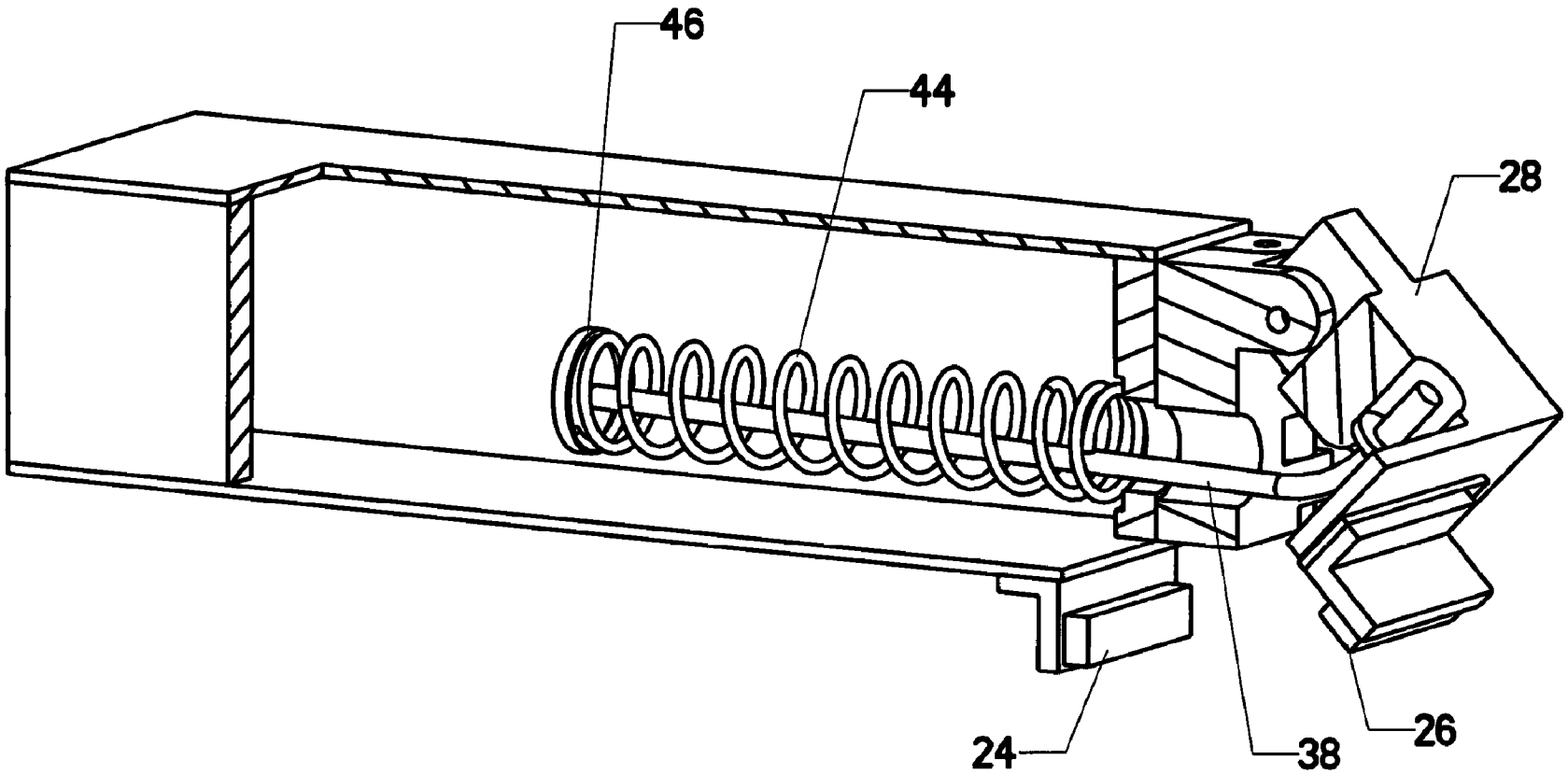
FIG. 10 is a partial section view, showing details of the combination hinge.

In the preferred embodiment, spring housing 12, combination hinge 14, and boom mount 18 are a single integrated unit. FIG. 10 illustrates the motion of the combination hinge when the boom deflects in the vertical direction. When outside pivot plate 28 moves in this direction, tension is applied to cable 38. Those that are skilled in the art will know that tension is also applied to cable 38 when the combination hinge breaks away in the horizontal direction. Spring 44 provides limited resistance to the movement of cable 38 and the combination hinge, and causes the components to return to their normal, undeflected position when the deflecting force is removed.

Figure 13:
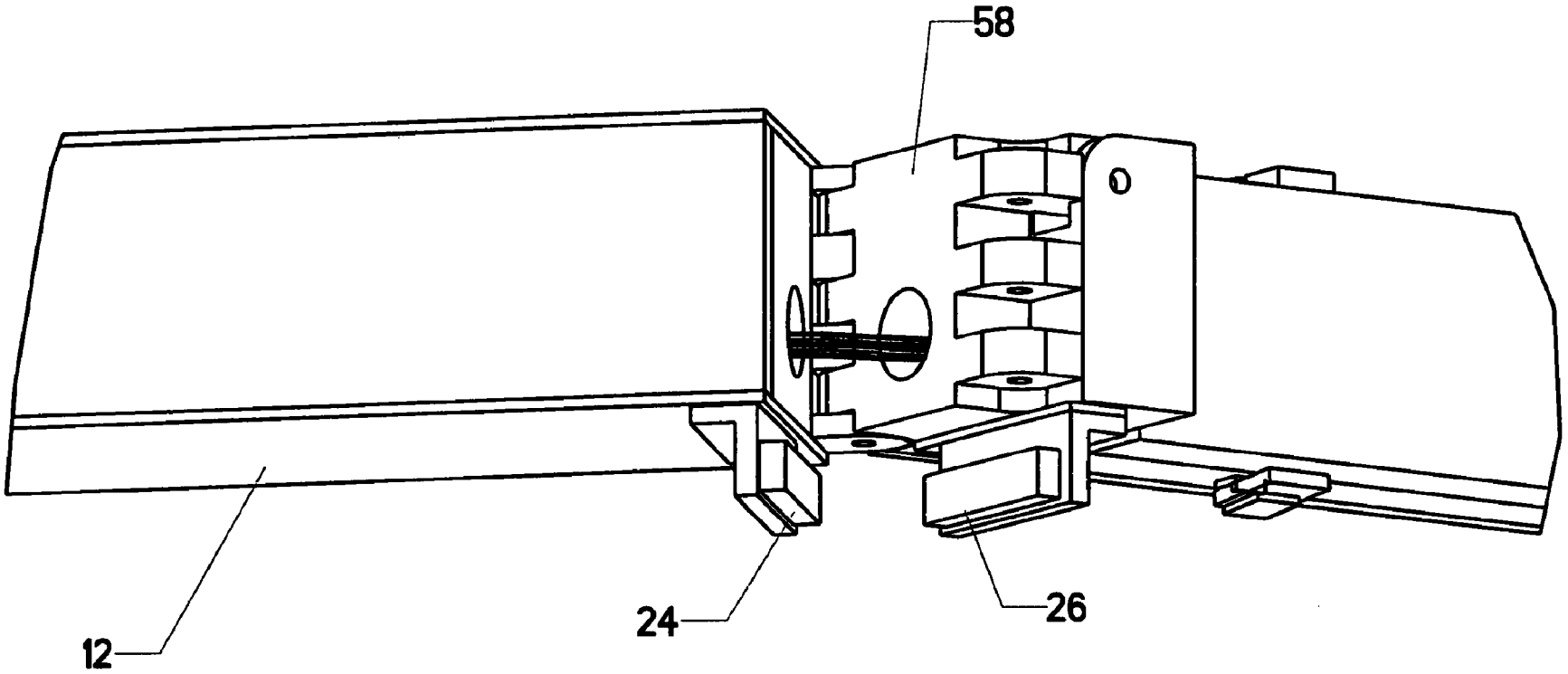
FIG. 13 is a detail view, showing horizontal breakaway of the combination hinge.
Figure 14:
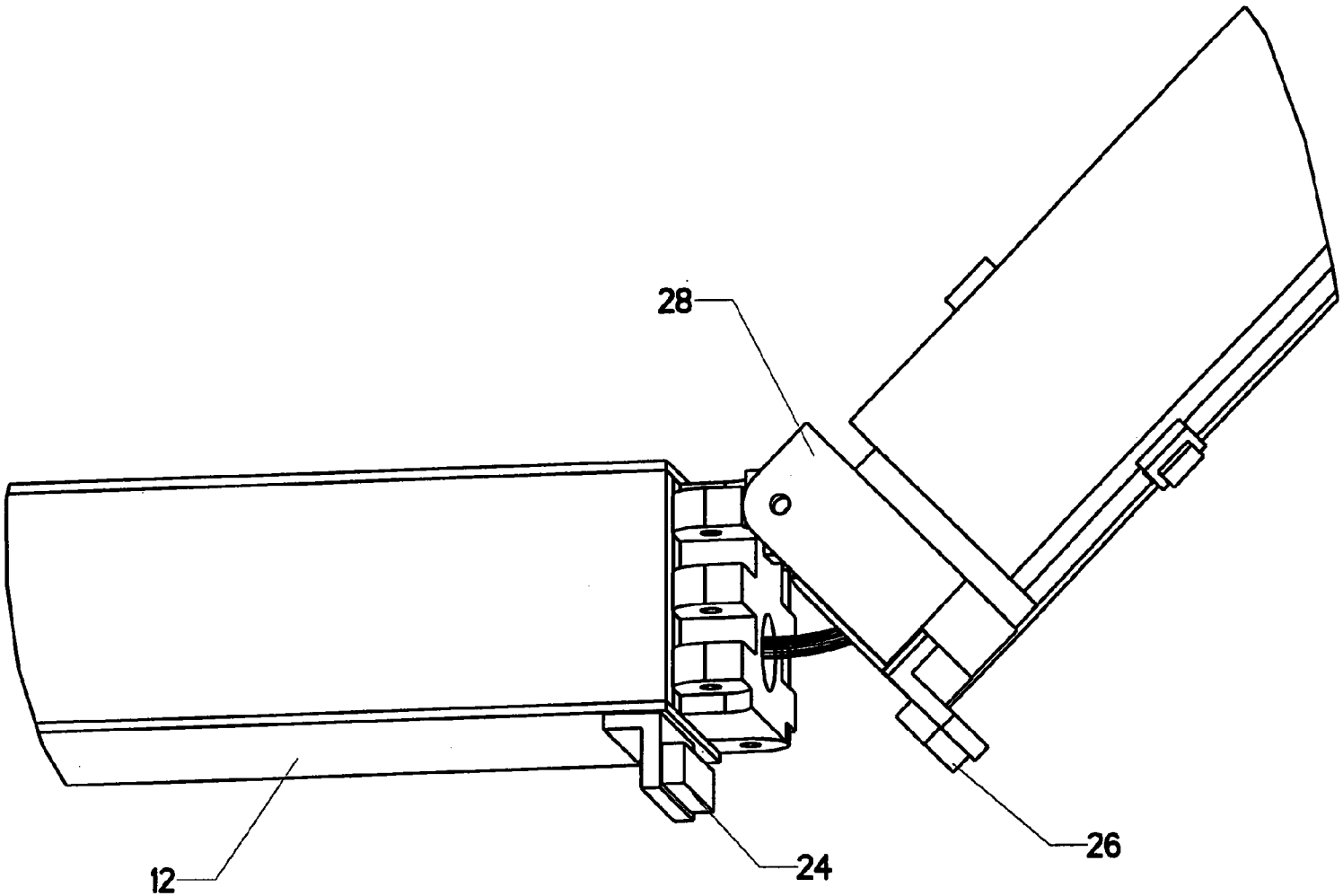
FIG. 14 is a detail view, showing vertical breakaway of the combination hinge.

As illustrated in FIGS. 13 and 14, deflection of the boom in either the horizontal or vertical directions causes magnet 26 to move away from sensor 24. FIG. 13 illustrates how horizontal deflection of the boom causes the combination hinge to break away in the horizontal direction. FIG. 14 illustrates how vertical deflection of the boom causes the combination hinge to break away in the vertical direction. In each case, the breakaway action of the combination hinge causes magnet 26 to move away from sensor 24. Sensor 24 is configured to detect the movement of magnet 26. In the preferred embodiment, sensor 24 detects movement of magnet 26 only when the boom is deflected at least fifteen degrees in either the horizontal or vertical direction.

Sensor 24 may be any magnetically reactive element including any variety of magnetically operated switches. In the preferred embodiment, a normally open switch is held closed by the magnet when the gate is in the undeflected position. This closed condition enable a first relay (such as a single pole, single throw relay) to be energized. The energized condition causes the common, normally closed contacts to be open. If the boom deflects more than 15 degrees in the horizontal or vertical direction, the switch will open causing the first relay to be deenergized. This deenergized condition will cause the common and normally closed contacts to conduct, which will energize a second relay. The energized condition of the second relay will "latch" one side of a normally open set of contacts to a closed condition. This closed condition will provide 24 volts to provide the "up" command for the gate. During the "up" travel of the fate, the original condition of the magnetically actuated switch is restored, the first relay is reenergized and the second relay is deenergized. Due to the fact the "up" signal was commanded, it does not matter when the magnetically actuated switch is restored.

The preceding description contains significant detail regarding the novel aspects of the present invention. It should not be construed, however, as limiting the scope of the invention but rather as providing illustrations of the preferred embodiments of the invention. As an example, various switches and control schemes may be used to control the movement of the gate. Thus, the scope of the invention should be fixed by the following claims, rather than by the examples given.

Having described my invention, I claim:

1. A safety system for use with a boom gate, said boom gate having a boom and a boom moving means for moving said boom between a down position and an up position, said safety system comprising:

a. a spring housing affixed to said boom moving means, wherein said spring housing has an end plate with a first opening passing therethrough;

b. a combination hinge, including i. a vertical pivot joint attached to said end plate of said spring housing and configured to allow said boom to deflect in a horizontal direction;

ii. an inside pivot plate pivotally attached to said end plate by said vertical pivot joint and said inside pivot plate having a second opening passing therethrough;

iii. a horizontal pivot joint attached to said inside pivot plate and configured to allow said boom to deflect in a vertical direction;

iv. an outside pivot plate pivotally attached to said inside pivot plate by said horizontal pivot joint;

v. said boom being attached to said outside pivot plate;

vi. a cable having a first end and a second end, wherein said cable passes through said first and second opening with said first end of said cable being attached to said outside pivot plate and said second end of said cable lying within said spring housing;

vii. a compression spring connecting said second end of said cable to said spring housing with said compression spring being positioned to place tension on said cable so that said cable biases said outside pivot plate toward said inside pivot plate and said inside pivot plate toward said end plate; and c. a boom deflection detector for detecting movement of one of said pivot plates relative to said spring housing.

2. The safety system of claim 1, further comprising a control system for actuating said boom moving means to move said boom to said up position whenever said movement of one of said pivot plates with respect to said spring housing is detected.

3. The safety system of claim 2, wherein said control system is configured to actuate said boom moving means to move said boom to said up position whenever said boom deflection detector detects angular deflection of said boom relative to said spring housing in the horizontal direction of at least fifteen degrees.

4. The safety system of claim 3, wherein said control system is configured to actuate said boom moving means to move said boom to said up position whenever said boom deflection detector detects angular deflection of said boom relative to said spring housing in said vertical direction of at least fifteen degrees.

5. The safety system of claim 1, wherein said boom deflection detector is configured to detect horizontal deflection of said boom relative to said spring housing.

6. The safety system of claim 5, wherein said boom deflection detector is further configured to detect vertical deflection of said boom relative to said spring housing.

7. The safety system of claim 1, wherein said boom deflection detector is configured to detect vertical deflection of said boom relative to said spring housing.

8. The safety system of claim 1, wherein said boom deflection detector includes a magnet attached to said outside pivot plate.

9. The safety system of claim 1, wherein said boom deflection detector further includes a magnet and a magnetically reactive element.

10. A safety system for use with a boom gate, said boom gate having a boom and a boom moving means for moving said boom between a down position and an up position, said safety system comprising:

a. a spring housing affixed to said boom moving means, wherein said spring housing has an end plate with a first opening passing therethrough;

b. a combination hinge, including i. a vertical pivot joint attached to said end plate of said spring housing and configured to allow said boom to deflect in a horizontal direction;

ii. an inside pivot plate pivotally attached to said end plate by said vertical pivot joint and said inside pivot plate having a second opening passing therethrough;

iii. a horizontal pivot joint attached to said inside pivot plate and configured to allow said boom to deflect in a vertical direction;

iv. an outside pivot plate pivotally attached to said inside pivot plate by said horizontal pivot joint;

v. said boom being attached to said outside pivot plate; and c. a magnetic sensor including a first part and a second part, wherein an increase in distance between said first part and said second part will trigger said magnetic sensor, said first part being attached to said spring housing proximate said end plate and said second part being attached to said outside pivot plate;

d. wherein said combination hinge includes a cable having a first end and a second end, wherein said cable passes through said first and second opening with said first end of said cable being attached to said outside pivot plate and said second end of said cable lying within said spring housing; and e. wherein said safety system includes a compression spring connecting said second end of said cable to said spring housing with said compression spring being positioned to place tension on said cable so that said cable biases said outside pivot plate toward said inside pivot plate and said inside pivot plate toward said end plate.

* * * * *